US005934664A

United States Patent [19]

Murayama et al.

[11] Patent Number: 5,934,664

[45] Date of Patent: Aug. 10, 1999

[54] PAPER FEEDING APPARATUS AND PRINTER

[75] Inventors: Susumu Murayama; Atsushi Nishizawa; Masaki Shimomura; Kenjiro Ishihara, all of Nagano, Japan

[73] Assignee: Seiko Epson Corporation, Tokyo, Japan

[21] Appl. No.: 08/882,258

[22] Filed: Jun. 25, 1997

[30] Foreign Application Priority Data

Jun. 25, 1996 [JP] Japan ..... 8-184154
Aug. 29, 1996 [JP] Japan ..... 8-247166

[51] Int. Cl.[6] ..... B65H 3/06

[52] U.S. Cl. ..... 271/118; 271/119; 271/121; 271/126

[58] Field of Search ..... 271/119, 118, 271/121, 124, 126, 167

[56] References Cited

U.S. PATENT DOCUMENTS 5,358,230 10/1994 Ikemori et al. ..... 271/121 X
5,582,399 12/1996 Sugiura ..... 271/119 X
5,738,348 4/1998 Yasue et al. ..... 271/119 X
5,775,684 7/1998 Jackson et al. ..... 271/119 X

FOREIGN PATENT DOCUMENTS 0 279 402 8/1988 European Pat. Off. .
8-3396 1/1996 Japan .

*Primary Examiner*—David H. Bollinger
*Attorney, Agent, or Firm*—Sughrue, Mion, Zinn, Macpeak & Seas, PLLC

[57] ABSTRACT

A paper feeding apparatus and a printer wherein an idle roller is brought into contact with a separation pad by a roller spring for generating urging force smaller than that of a separation pad for separating a paper sheet to be fed by a paper feeding roller having a D-shape side cross section from a next paper sheet; a restraining pin for restraining movement of the separation pad toward the paper feeding roller when the paper sheet is not held between the separation pad and the paper feeding roller is provided; a pair of conveying rollers are temporarily and inversely rotated after the leading end of the paper sheet has passed through a nipping portion between the pair of the conveying rollers and in a state where the paper sheet is not held between the separation pad and a circular-arc portion of the paper feeding roller so as to arrange the leading end of the paper sheet along the nipping portion so that diagonal conveyance of the paper sheet is smoothly prevented and the load acting on the fed paper sheet is reduced.

11 Claims, 15 Drawing Sheets

PAPER FEEDING APPARATUS AND PRINTER

BACKGROUND OF THE INVENTION

1. Field of the Invention

The present invention relates to a paper feeding apparatus for feeding stacked paper sheets (plain paper, coat paper, an OHP (Over Head Projector) sheet, glossy paper, a cut sheet such as a glossy film) one sheet at a time beginning with the uppermost paper sheet, and more particularly to a paper feeding apparatus suitable for use in a printer.

The present invention relates to a printer having the above-mentioned paper feeding apparatus, which, one by one, feeds stacked paper sheets beginning with the uppermost paper sheet, so as to print the fed paper sheets. More particularly, the present invention relates to a technique for preventing diagonal conveyance of a fed paper sheet with respect to the conveying direction.

2. Related Art

An example of the schematic structure of a usual printer is shown in FIG. 13.

Referring to FIG. 13, reference numeral 1 represents a paper feeding apparatus for, one by one, feeding paper sheets P. The fed paper sheet P is conveyed such that it is held by a pair of conveying rollers 2 and 3, and then printed by a printing means 4 and discharged to the outside of the apparatus by a pair of discharge rollers 5 and 6.

As the paper feeding apparatus 1, a structure as shown in FIG. 14 is available (refer to Japanese Utility Model Publication No. Hei. 8-3396). Referring to the figure above, reference numeral 10 represents a paper feeding roller having a D-shape side cross section and composed of a circular-arc portion 10*a* and a straight portion 10*b*.

Reference numeral 11 represents a guide block. A shaft 10*c* of a paper feeding roller 10 is supported by the guide block 11.

Reference numeral 12 represents a cassette including a stacking plate 12*a*. A plurality of paper sheets P are, in a stacked state, set on the stacking plate 12*a*. Reference numeral 12*c* represents a spring. The spring 12*c* urges the paper sheet P toward the paper feeding roller 10.

Reference numeral 13 represents a separation pad attached to the upper surface of a bracket 13*a*. The separation pad 13 is disposed in a rotation locus for the circular-arc portion 10*a* of the paper feeding roller 10 and, by a spring 14, urged in a direction of the shaft 10*c* along the guide 15.

Reference numeral 16 represents an idle roller rotatively attached to the guide block 11. Reference numeral 17 represents a movable idle roller having a shaft 17*a* movably received within an elongated groove 11*a* of the guide block 11. The movable idle roller 17 is, by a spring 18, urged toward the separation pad 13 so as to be in contact with the separation pad 13.

Urging force F2 of the spring 18 is made to be smaller than urging force F1 of the spring 14 of the separation pad 13 (that is, F1>F2).

The paper feeding apparatus structured as described above is operated as follows.

In a standby mode, a straight portion 10*b* of the paper feeding roller 10 is placed opposite to the paper sheet P, as shown in FIG. 14, such that the paper feeding roller 10 is not in contact with the paper sheet P. Since the urging force F2 of the spring 18 of the movable idle roller 17 is smaller than the urging force F1 of the spring 14 of the separation pad 13, the movable idle roller 17 is pushed upwards by the separation pad 13. Thus, its shaft 17*a* is in contact with the top end of the elongated groove 11*a*.

When the paper feeding operation is performed, the paper feeding roller 10 is rotated in a direction indicated by an arrow. When the circular-arc portion 10*a* is brought into contact with the uppermost paper sheet P1 among the paper sheets P, the paper sheet P1 is fed toward the separation pad 13. Since a paper sheet P2 next to the paper sheet P1 are attracted to one another due to the static electricity, and since frictional force acts between the paper sheet P1 and the paper sheet P2, the paper sheet P2 is sometimes fed together with the paper sheet P1.

However, the paper sheet P2 is separated from the paper sheet P1 by the separation pad 13 as follows so that only the uppermost paper sheet P1 is fed.

That is, the movement of the paper sheet P2 is prevented because its leading end is brought into contact with the separation pad 13 so that the paper sheet P2 is primarily separated from the paper sheet P1.

Assuming that the frictional force between the circular-arc portion 10*a* of the paper feeding roller 10 and the paper sheet P1 is f1, the frictional force between the paper sheet P2 and the separation pad 13 is f2 and the frictional force between the paper sheet P1 and the paper sheet P2 is f3, the paper feeding roller 10 and the separation pad 13 are structured to establish the relationships f1>f2>f3. Therefore, when both of the paper sheet P1 and the paper sheet P2 have been brought to a state where they are held by the circular-arc portion 10*a* of the paper feeding roller and the separation pad 13 attributable to the rotation of the paper feeding roller 10, the movement of the paper sheet P2 is prevented by the frictional force generated between the paper sheet P2 and the separation pad 13. Thus, the paper sheet P2 is secondarily separated from the paper sheet P1 so that only the paper sheet P1 is fed. Since the separation pad 13 is disposed in the rotation locus of the circular-arc portion 10*a* of the paper feeding roller 10, the rotation of the circular-arc portion 10*a* causes the separation pad 13 to be pushed downwards by the circular-arc portion 10*a*. However, the movable idle roller 17, which is urged toward the separation pad 13 by the spring 18, is brought into contact with the separation pad 13 even if the separation pad 13 has been pushed downwards. Also the thus-maintained contact causes the paper separation operation to be performed.

After the paper feeding roller 10 has been rotated one time, the standby state (the state shown in FIG. 14) is restored.

As described above, only the uppermost paper sheet P1 is fed.

When the above-mentioned paper feeding apparatus (shown in FIG. 14) is employed by a printer structured, for example, as shown in FIG. 13, the fed paper sheet P1 is conveyed while being held between the pair of the conveying rollers 2 and 3, and then printed by the printing means 4. When conveyance of the paper sheet P1 has been started by the pair of the conveying rollers 2 and 3, the paper sheet P1 has not completely been separated from the paper feeding apparatus in general. That is, the paper sheet P1 is in a state where its trailing end is held by the separation pad 13 and the movable idle roller 17.

Therefore, the paper sheet P1 is conveyed by the pair of the conveying rollers 2 and 3 in a state (a state where the paper sheet P1 is pulled rearwards, that is, a state where the paper sheet P1 is applied with a back tension) where the paper sheet P1 bears the load applied from the holding portion until the trailing end of the paper sheet P1 passes through the holding portion between the separation pad 13 and the movable idle roller 17. The reason why the structure is employed in which the movable idle roller 17 is urged toward the separation pad 13 to hold the paper sheet P1 between the movable idle roller 17 and the separation pad 13 lies in that conveyance of the paper sheet P2 together with the paper sheet P1 when the paper sheet P1 is attempted to be fed must be prevented, the conveyance being performed due to the adsorption of the paper sheet P2 to the paper sheet P1 attributable to the static electricity or frictional force generated between the paper sheet P1 and the paper sheet P2.

However, the above-mentioned paper feeding apparatus encounters enlargement of the back tension because the load in the holding portion between the separation pad 13 and the movable idle roller 17 is too large.

When the paper feeding roller 10 has been rotated one time for feeding the paper and thus the state (the state where the circular-arc portion 10*a* does not press the separation pad 13) shown in FIG. 14 has been realized as described above, the above-mentioned paper feeding apparatus, set such that the urging force F1 of the spring 14 of the separation pad 13 is larger than the urging force F2 of the spring 18 of the movable idle roller 17, causes the separation pad 13 to be brought to a state of stoppage such that the movable idle roller 17 has been pushed upwards until the shaft 17*a* of the movable idle roller 17 is brought into contact with the top end of the elongated groove 11*a*.

That is, the foregoing paper feeding apparatus is structured such that the paper sheet P1 is conveyed by the pair of the conveying rollers 2 and 3 in a state where the trailing end of the paper sheet P1 is held between the separation pad 13 and the movable idle roller 17 by the urging force F1 of the spring 14 of the separation pad 13.

Since the separation pad 13 is structured to hold the paper sheet between the separation pad 13 and the circular-arc portion 10*a* of the paper feeding roller 10 so as to prevent conveyance of two or more paper sheets, the urging force F1 of the separation pad 13 must be relatively large (at least larger than the urging force F2 of the movable idle roller 17 as described above).

Therefore, since the above-mentioned paper feeding apparatus is structured such that the trailing end of the paper sheet P1 is held by the relatively large urging force F1, a great load is generated in the holding portion.

In a case where conveyance force capable of overcoming the above-mentioned load cannot be obtained by the pair of the conveying rollers 2 and 3, the paper feeding accuracy deteriorates. As a result, the printing accuracy realized by the printing means 4 deteriorates.

Therefore, the foregoing paper feeding apparatus must enlarge the paper holding force which is realized by the pair of the conveying rollers 2 and 3 in order to obtain the conveyance force sufficiently overcoming the above-mentioned load. Moreover, a great drive power is required to operate the pair of the conveying rollers 2 and 3. As a result, the size of the apparatus is enlarged and the electric power consumption is also enlarged. What is worse, the pair of the conveying rollers 2 and 3 are easily worn.

A paper sheet which is fed by the paper feeding apparatus is sometimes fed diagonally relative to the conveying direction. Since the fed paper sheet is usually conveyed by the pair of the conveying rollers 2 and 3 and printed by the printing means 4 as shown in FIG. 13, the diagonal conveyance of the paper sheet results in printing being performed diagonally. Therefore, the diagonal conveyance of the paper sheet must be prevented.

As a technique for preventing the diagonal conveyance of a paper sheet, a technique as shown in FIGS. 15 (*a*) and 15 (*b*) is known in which a paper sheet is fed by a single paper feeding roller 7; and then the paper feeding roller 7 is stopped after the leading end P1*a* of the fed paper sheet P1 has allowed to pass through a nipping portion (the holding portion) N between the pair of the conveying rollers 2 and 3, followed by temporarily and inversely rotating the pair of the conveying rollers 2 and 3.

If the pair of the conveying rollers 2 and 3 are rotated inversely in a state where the paper sheet P1 is conveyed diagonally, the timing, at which the leading end P1*a* of the paper sheet passes through, in the opposite direction, the nipping portion N between the pair of the conveying rollers 2 and 3, is different for each widthwise edge of the paper sheet. In a case where the paper sheet P1 is conveyed diagonally, for example, as indicated by an imaginary line shown in FIG. 15 (*a*), the leading end P1*a*1 which is the upper portion when viewed in FIG. 15 (*a*) passes through the nipping portion N, and then a leading end P1*a*2, which is the lower portion, passes through the same. That is, a state is realized in which the conveying force generated by the pair of the conveying rollers 2 and 3 does not act on the leading end P1*a*1 which is the upper portion and the conveying force acts on the leading end P1*a*2 in the lower portion.

Since the paper feeding roller 7 is stopped in the above-mentioned state, the paper sheet P1 is rotated in a direction indicated by an arrow X shown in FIG. 15 (*a*). As a result, the leading end P1*a* of the paper sheet is arranged along the nipping portion between the pair of the conveying rollers 2 and 3.

Then, the pair of the conveying rollers 2 and 3 are rotated forwards so that the paper sheet P1 is conveyed straight.

Some paper feeding apparatuses for the printers have a structure such that a paper feeding tray 12' is, as shown in FIG. 16 (*b*), positioned diagonally to reduce the overall area required for installing the printer.

If the paper feeding tray 12' is diagonally disposed as described above, the deadweight of the paper sheet P1 acts in the conveying direction during the conveyance. Therefore, if a single paper feeding roller is employed, the paper sheet can easily be conveyed diagonally.

Accordingly, an apparatus of the foregoing type has been structured such that at least a pair of the paper feeding rollers 7' are provided as shown in FIG. 16 (*a*) to prevent diagonal conveyance when the paper sheet is conveyed. However, if one pair of the paper feeding rollers 7' are provided, the above-mentioned technique for preventing diagonal conveyance (see FIGS. 15 (*a*) and 15 (*b*)) cannot prevent the diagonal conveyance of the paper sheet. Since the pair of the paper feeding rollers 7' are attached to a common drive shaft 7*a* to simultaneously press the paper sheet P1, the inverse rotation of the pair of the conveying rollers 2 and 3 cannot rotate the paper sheet P1.

If the pair of the paper feeding rollers 7' are attached to individual drive shafts to enable the paper feeding rollers 7' to be rotated independently and freely when the pair of the conveying rollers 2 and 3 are rotated inversely, the above-mentioned technique (see FIGS. 15 (*a*) and 15 (*b*)) for preventing the diagonal conveyance is able to prevent the diagonal conveyance of the paper sheet. However, if the pair of the paper feeding rollers 7' are attached to the individual drive shafts, the two drive shafts must be synchronized with each other to prevent excessive diagonal conveyance of the paper sheet when the paper sheet is fed. In order to make the paper feeding rollers 7' capable of independently and freely rotating when the pair of the conveying rollers 2 and 3 are rotated inversely, a clutch and so forth are required. Thus, the structure becomes too complicated.

Therefore, the structure, in which the pair of the paper feeding rollers 7' are attached to the individual drive shafts to make the paper feeding rollers 7' capable of independently and freely rotating when the pair of the conveying rollers 2 and 3 are rotated inversely, is not an advantageous structure.

On the other hand, the structure formed as shown in FIG. 14, which is provided with the paper feeding roller 10 having a D-shape side cross section and the movable idle roller 17 capable of independently and freely rotating with respect to the paper feeding roller 10, is considered to be able to use the above-mentioned diagonal conveyance preventive technique (see FIGS. 15 (*a*) and 15 (*b*)). If the pair of the conveying rollers are rotated inversely in a state where the paper feeding roller 10 is not pressing the paper sheet, the rotation of the movable idle roller 17 also serving as a load is considered to be capable of rotating the paper sheet.

However, the structure shown in FIG. 14 cannot easily and smoothly rotate the paper sheet, that is, smoothly prevent the diagonal conveyance and cannot rotate the same because of the following reason.

Since the structure shown in FIG. 14 is formed such that the urging force F1 of the spring 14 of the separation pad 13 is larger than the urging force F2 of the spring 18 of the movable idle roller 17, the separation pad 13 is brought into a state of stoppage in which the separation pad 13 has upwardly pushed the movable idle roller 17 until the shaft 17*a* of the movable idle roller 17 is brought into contact with the top end of the elongated groove 11*a* when the paper feeding roller 10 has been rotated one time to be brought to the state shown in FIG. 14 (the state in which the circular-arc portion 10*a* does not press the separation pad 13).

If the pair of the conveying rollers are rotated inversely to rotate the paper sheet P1 in the foregoing state, the paper sheet P1 is attempted to be rotated in a state where its trailing end is held between the separation pad 13 and the movable idle roller 17 by the urging force F1 of the spring 14 of the separation pad 13.

However, since the separation pad 13 is arranged to hold the paper sheet between the separation pad 13 and the circular-arc portion 10*a* of the paper feeding roller 10 so as to prevent conveyance of two or more paper sheets as described above, the urging force F1 of the separation pad 13 is relatively large (at least larger than the urging force F2 of the movable idle roller 17 as described above).

Therefore, the paper sheet P1 must be rotated in a state where the trailing end of the paper sheet P1 is held as described above by the relatively large urging force F1. As a result, the paper sheet P1 cannot easily be rotated.

That is, the structure shown in FIG. 14 cannot easily prevent the diagonal conveyance of a paper sheet.

SUMMARY OF THE INVENTION

A first object of the present invention is to provide a paper feeding apparatus capable of reducing a load acting on a paper sheet after an uppermost paper sheet has been fed.

A second object of the present invention is to provide a printer having a paper feeding apparatus provided with a paper feeding roller having a D-shape side cross section and a movable idle roller and capable of smoothly preventing diagonal conveyance of a paper sheet.

A paper feeding apparatus according to the present invention comprises a paper feeding roller being D-shaped in a side cross sectional view, and including a circular-arc portion and a straight portion, the paper feeding apparatus being rotated one time, so that the circular-arc portion is brought into contact with an uppermost paper sheet of a plurality of stacked paper sheets so as to feed the paper sheet; a separation pad located in a rotation locus of the circular-arc portion of the paper feeding roller and being urged by pad urging means toward the paper feeding roller, so that the paper sheet is held between the separation pad and the circular-arc portion so as to separate the paper sheet to be fed by the paper feeding roller from the next paper sheet; an idle roller which is urged toward the separation pad by roller urging means for generating an urging force smaller than urging force generated by the pad urging means so as to be brought into contact with the separation pad; and pad restraining means for restraining movement of the separation pad toward the paper feeding roller when the separation pad does not hold the paper sheet between the separation pad and the circular-arc portion of the paper feeding roller, the pad restraining means being provided separately from the idle roller.

A printer according to the present invention comprises a feeding tray for holding a plurality of paper sheets in a state where the paper sheets are stacked; a paper feeding roller being D-shaped in a side cross sectional view, and including a circular-arc portion and a straight portion, the paper feeding apparatus being rotated one time, so that the circular-arc portion is brought into contact with an uppermost paper sheet of the plurality of stacked paper sheets on the feeding tray so as to feed the paper sheet; a separation pad located in a rotation locus of the circular-arc portion of the paper feeding roller and being urged by pad urging means toward the paper feeding roller, so that the paper sheet is held between the separation pad and the circular-arc portion so as to separate the paper sheet to be fed by the paper feeding roller from the next paper sheet; an idle roller which is urged toward the separation pad by roller urging means for generating urging force smaller than urging force generated by the pad urging means so as to be brought into contact with the separation pad; pad restraining means for restraining movement of the separation pad toward the paper feeding roller when the separation pad does not hold the paper sheet between the separation pad and the circular-arc portion of the paper feeding roller, the pad restraining means being provided separately from the idle roller; and a pair of conveying rollers for conveying the paper sheet fed by the paper feeding roller; wherein the pair of conveying rollers are temporarily rotated in an inverse direction to arrange a leading end of the paper sheet along a nipping portion between the pair of conveying rollers after the leading end of the paper sheet has passed through the nipping portion and in a state where the separation pad and the circular-arc portion of the paper feeding roller do not hold the paper sheet.

DETAILED DESCRIPTION OF PREFERRED EMBODIMENTS

An embodiment of the present invention will now be described with reference to the drawings.

Figure 1:
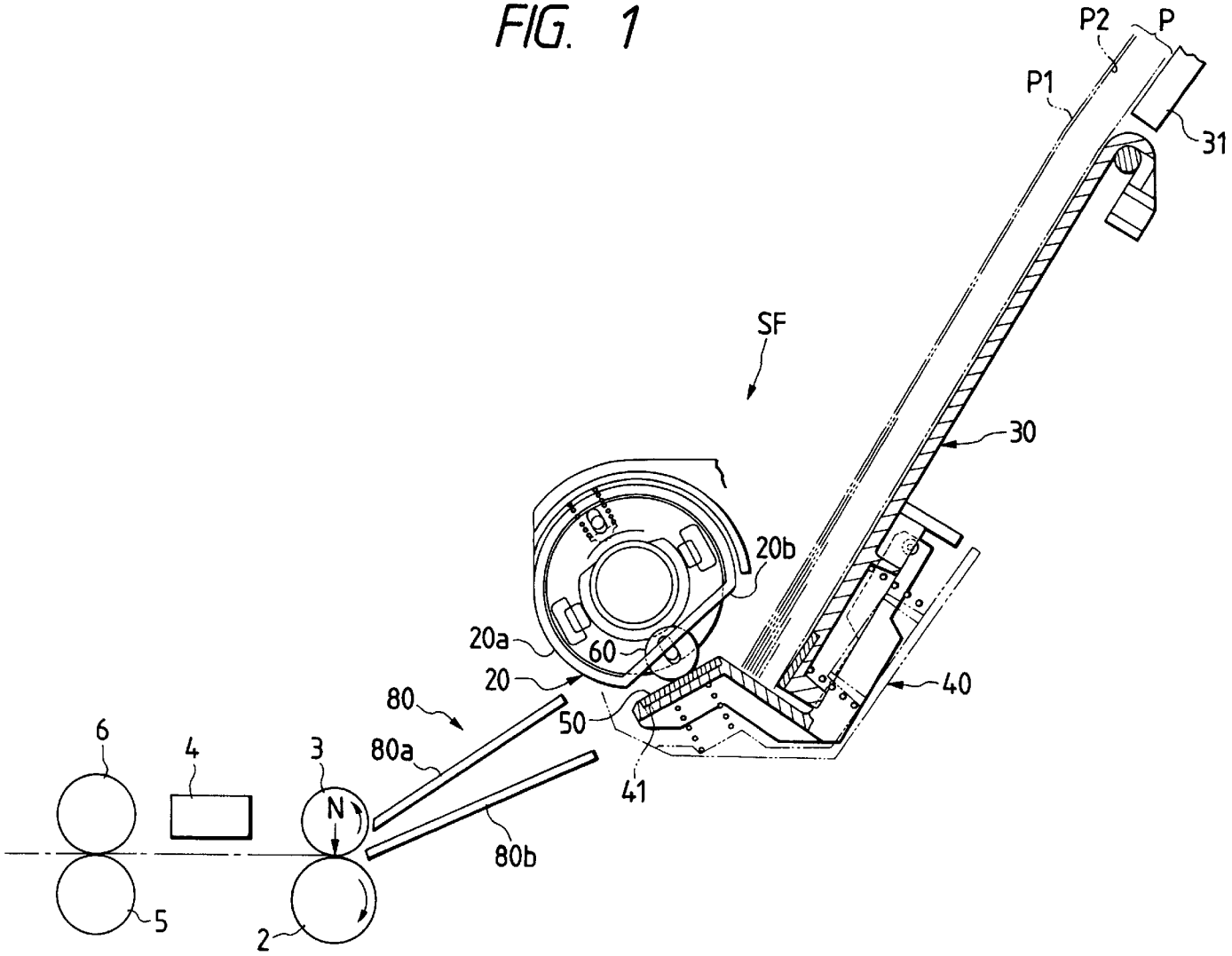
FIG. 1 is a side view showing an essential portion of an embodiment of a paper feeding apparatus and a printer according to the present invention.
Figure 2:
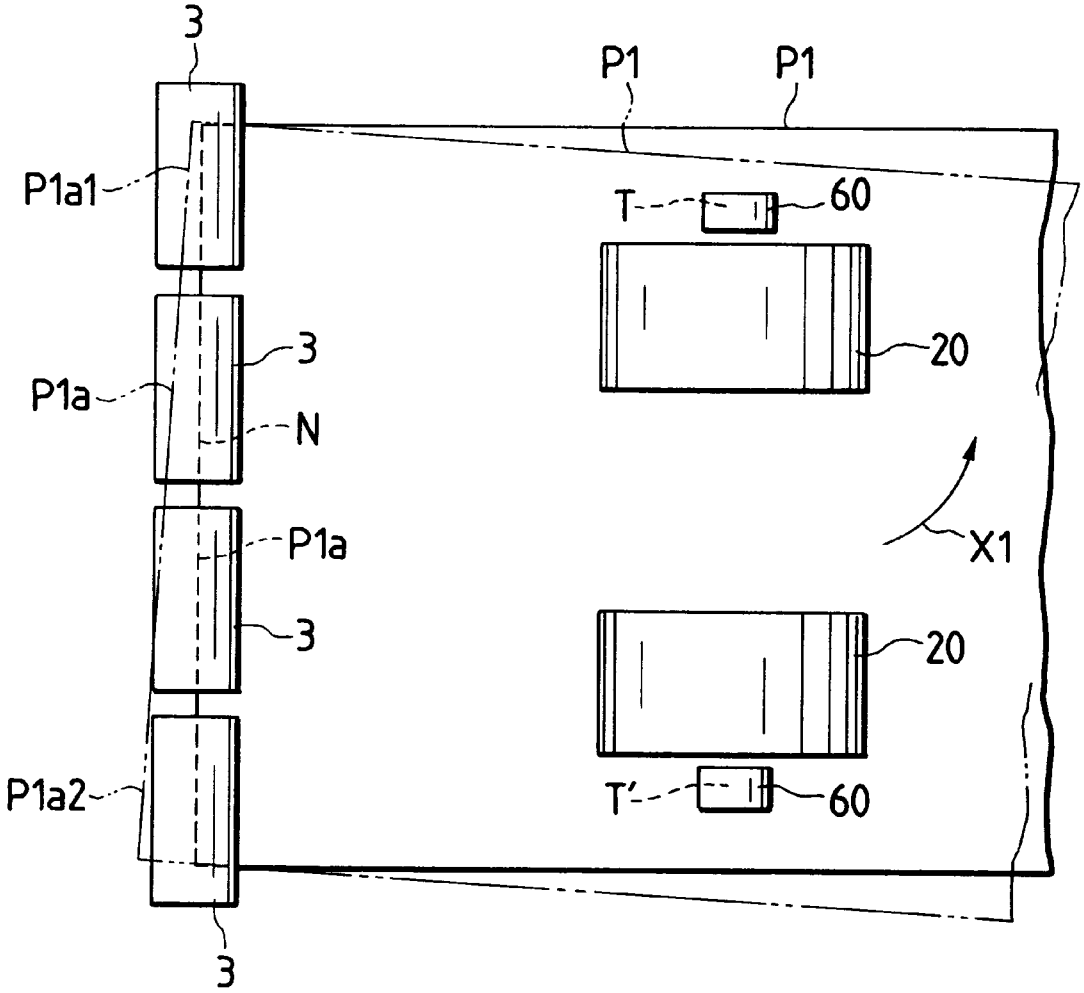
FIG. 2 is a partially-cut schematic plan view of the same.
Figure 3:
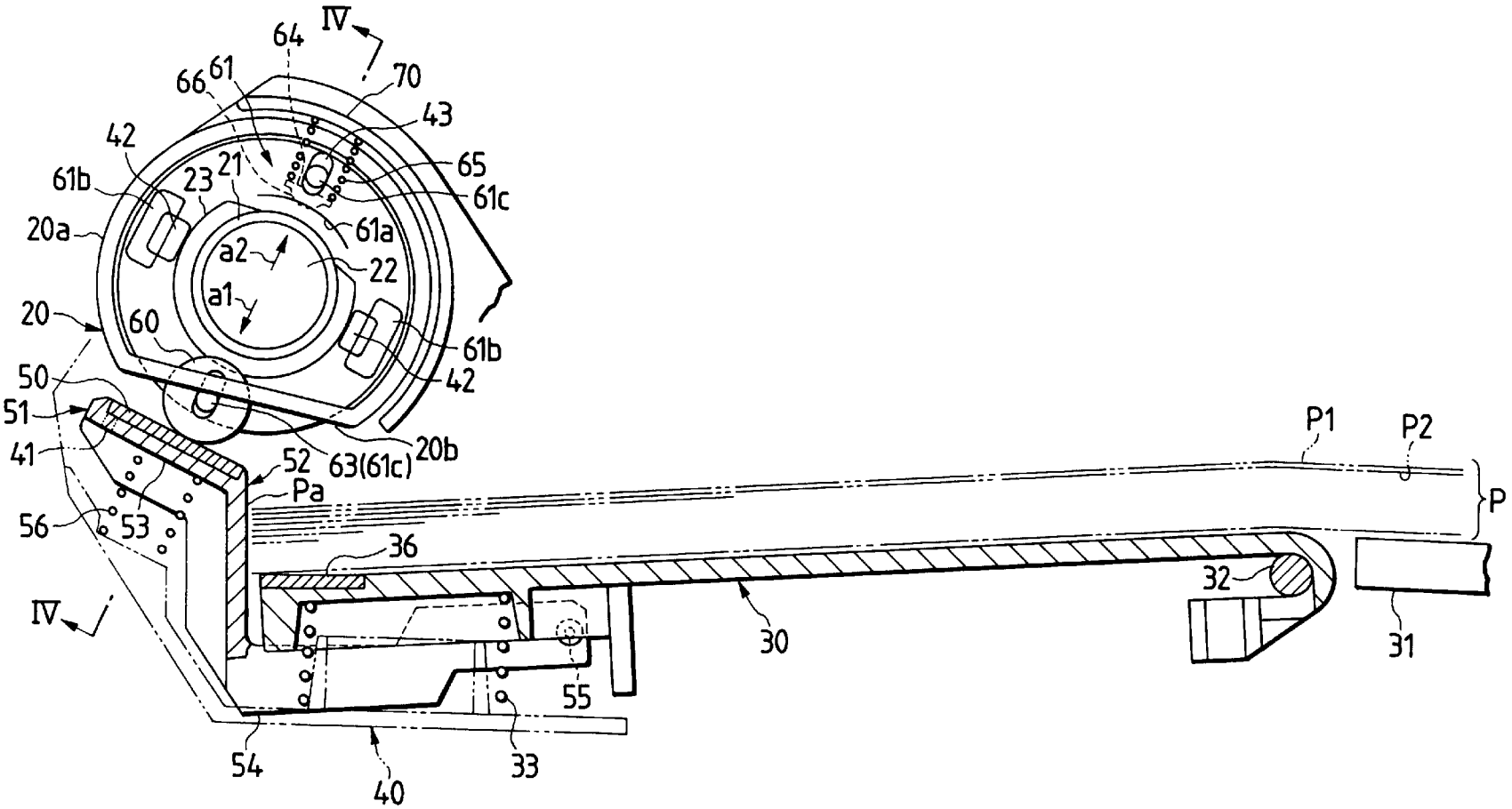
FIG. 3 is a partially-cut and a partially perspective side view which is a partially enlarged view of FIG. 1.
Figure 4:
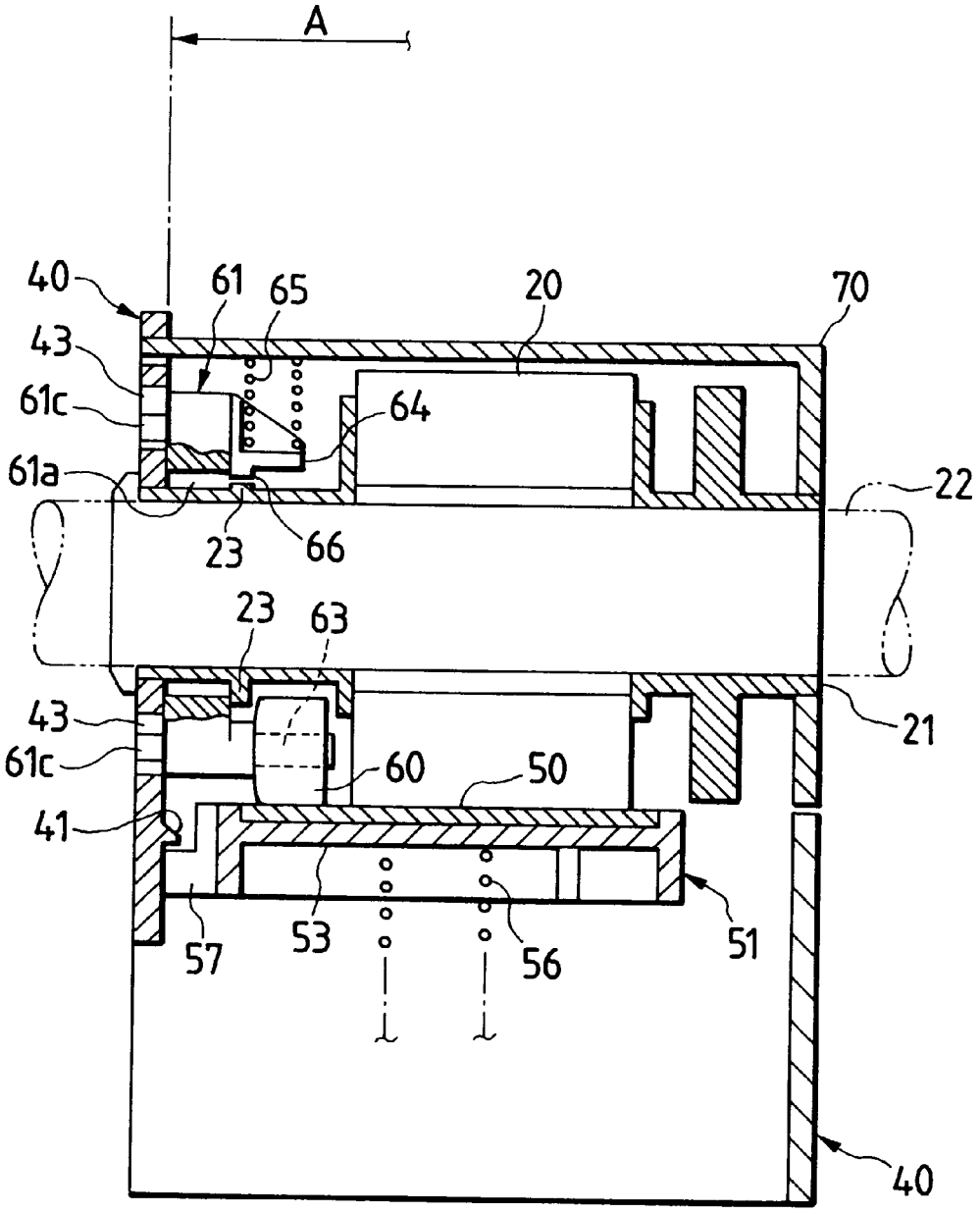
FIG. 4 is a cross sectional view taken along line IV—IV shown in FIG. 3.

FIG. 1 is a side view showing an essential portion of an embodiment of a paper feeding apparatus and a printer using the paper feeding apparatus according to the present invention. FIG. 2 is a partially-cut schematic plan view. FIG. 3 is a partially enlarged, partially cut and partially perspective side view of FIG. 1. FIG. 4 is a cross sectional view taken along line IV—IV shown in FIG. 3.

Referring to FIG. 1, symbol SF represents a paper feeding apparatus included in a printer. Reference numerals 2 and 3 represent a pair of conveying rollers, 4 represents a printing means (for example, an ink jet head), 5 and 6 represent a pair of paper discharge rollers and 80 represents a paper sheet guide having an upper guide 80*a* and a lower guide 80*b*.

Reference numeral 20 represents one of a pair of paper feeding rollers disposed as shown in FIG. 2.

FIG. 3 is an enlarged view of the paper feeding apparatus SF which is drawn from an angle different from an angle with which FIG. 1 is drawn. In actual, the paper feeding apparatus SF is included in the printer such that a paper feeding tray 31 and a hopper 30, to be described later, are inclined, as shown in FIG. 1.

As shown in FIG. 3, each paper feeding roller 20 has a D-shape side cross section having a circular-arc portion 20*a* and a straight portion 20*b*. At least the surface of the circular-arc portion 20*a* and that of the straight portion 20*b* are made of a large friction material (for example, rubber). The paper feeding rollers 20 are secured to a paper-feeding roller shaft 22 through bushings 21. That is, the paper feeding rollers 20 and the bushings 21 cannot rotate with respect to the paper-feeding roller shaft 22. The paper-feeding roller shaft 22 is supported by a frame (not shown) so as to be rotated by a drive means (not shown) when a paper sheet is fed.

Reference numeral 30 represents a hopper, and 31 represents a paper feeding tray. The hopper 30 is, by a shaft 32, rotatively attached to a printer frame, while the paper feeding tray 31 is detachably secured to the frame. A plurality of paper sheets P are set on the hopper 30 and the paper feeding tray 31 such that the paper sheets P are diagonally stacked, as shown in FIG. 1. The set paper sheets P are arranged so that their leading ends Pa are brought into contact with a rear side 52 of a separation pad holder 51 (see FIG. 3).

Figure 5:
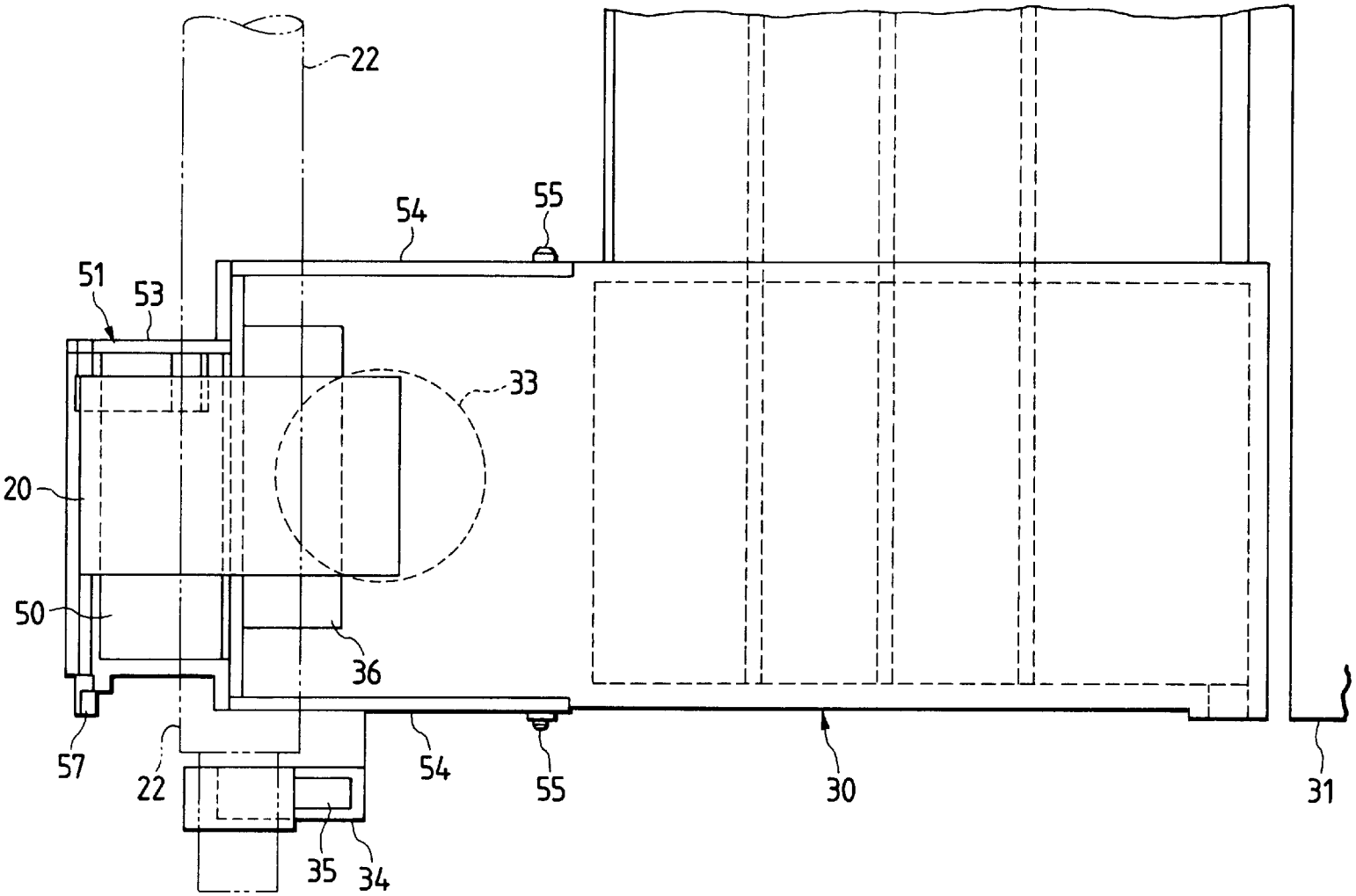
FIG. 5 is a partially-cut plan view.
Figure 6:
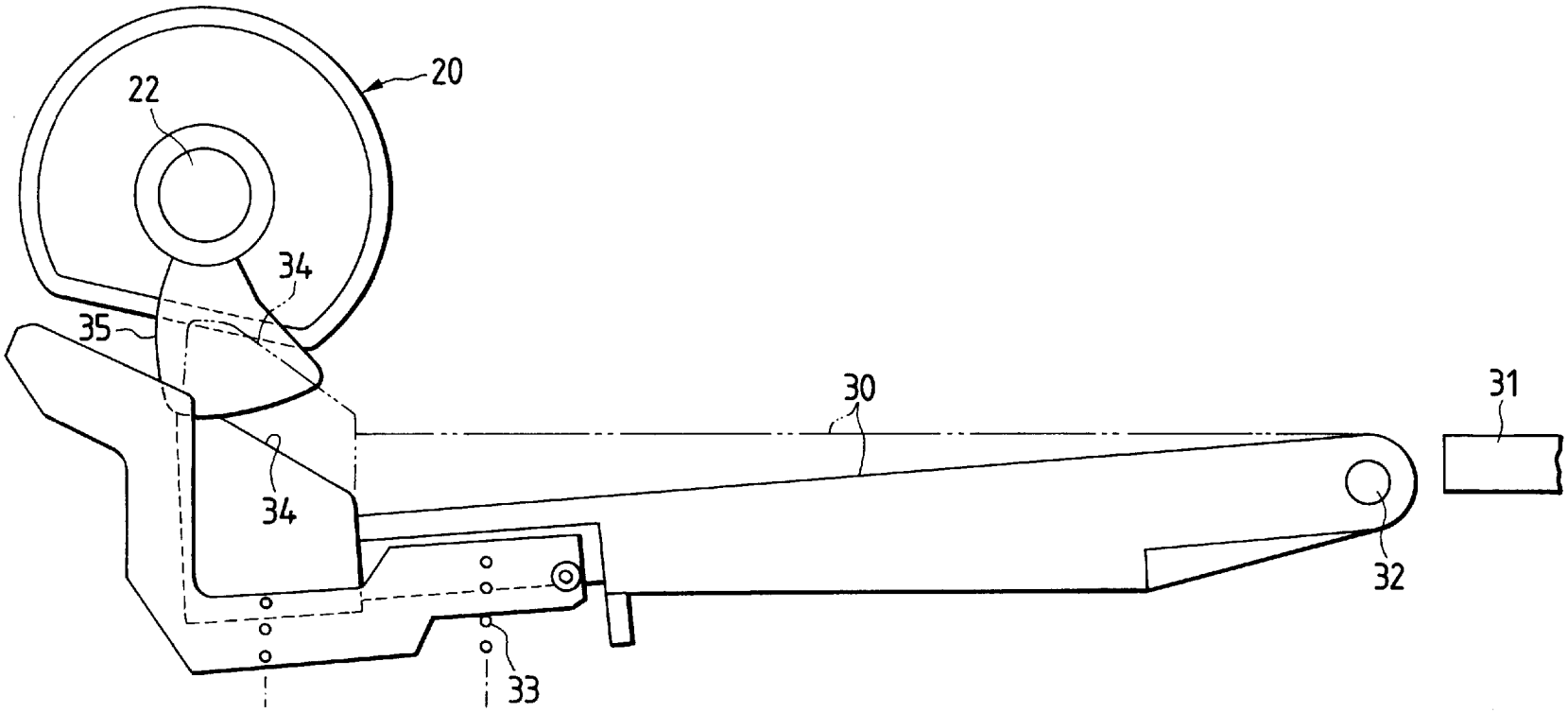
FIG. 6 is a side view similar to FIG. 3 with several positions omitted.

Reference numeral 40 represents a sub-frame. A hopper spring (a compression spring) 33 is disposed between the sub-frame 40 and the leading end of the hopper 30 (see FIG. 5). Therefore, the hopper 30 is, by the hopper spring 33, always urged clockwise when viewed in FIG. 3, that is, into a direction in which the paper sheet P is brought into contact with the paper feeding roller 20. As shown in FIGS. 5 and 6, a cam follower 34 is formed at each of the two side ends (only one side end is shown in FIG. 5) of the hopper 30. When the cam followers 34 are brought into contact with the hopper cams 35 (only one of the hopper cams 35 is shown in FIG. 5) secured to the paper-feeding roller shaft 22, their rotations are prevented. A pad 36 formed similarly to a separation pad, to be described later, is disposed on the upper surface of the leading end of the hopper 30.

Referring to FIGS. 3 to 5, reference numeral 50 represents a separation pad secured to a separation pad holder 51. The separation pad 50 is made of a material (for example, cork) having a coefficient of friction smaller than the coefficient of friction of the paper feeding roller 20. The foregoing materials have coefficients of friction larger than the coefficient of friction between paper sheets. That is, assuming that the coefficient of friction between the paper feeding roller 20 and the paper sheet is $\mu 1$, the coefficient of friction between the separation pad 50 and the paper sheet is $\mu 2$ and the coefficient of friction between the paper sheets is $\mu 3$, the following relationship $\mu 1 > \mu 2 > \mu 3$ is satisfied.

The separation pad holder 51 has a pad support portion 53, to which the separation pad 50 is secured, the foregoing rear side 52 formed integrally with the pad support portion 53 and a pair of arm portions 54 formed integrally with the rear side 52, the separation pad holder 51 being rotatively attached to the sub-frame 40 by a shaft 55 disposed at the rear end of the arm portions 54.

Between the pad support portion 53 and the sub-frame 40, there is disposed a pad spring (a compression spring) 56 which is a pad urging means. Therefore, the separation pad holder 51 is, by the pad spring 56, always urged clockwise when viewed in FIG. 3, that is, into a direction in which the separation pad 50 is brought into contact with the paper feeding roller 20. As shown in FIG. 4, a projection 57 is formed at an end of the separation pad holder 51. When the projection 57 is brought into contact with a pin 41 provided for the sub-frame 40 and serving as a pad restraining means, its rotation is restrained. In a state where the projection 57 is in contact with the pin 41, the separation pad 50 is located in a rotation locus of the circular-arc portion 20*a* of the paper feeding roller.

Referring to FIGS. 3 and 4, reference numeral 60 represents an idle roller, and 61 represents an idle roller holder. Reference numeral 70 represents a cover for the paper feeding roller 20, the cover 70 being attached to the sub-frame 40.

The idle roller holder 61 is formed into an annular shape having an opening 61*a* in the central portion thereof. A shaft 63 is disposed below one side surface of the idle roller holder 61, the shaft 63 rotatively supporting the idle roller 60.

The idle roller holder 61, as shown in FIG. 3, has a pair of openings 61*b*. Hooks 42 provided for the sub-frame 40 are loosely received in the openings 61*b* so that the idle roller holder 61 is attached to the sub-frame 40. A pair of pins 61*c* respectively are disposed on another side surface of the idle roller holder 61 and below the same. The pins 61*c* are slidably received within elongated holes 43 formed in the sub-frame 40 (see FIG. 4). Moreover, the paper-feeding roller shaft 22 is allowed to pass through the opening 61*a* of the idle roller holder 61. The diameter of the opening 61*a* is made to be larger than the diameter of the paper-feeding roller shaft 22.

Therefore, the idle roller holder 61 is able to slide in directions indicated by arrows a1 and a2 shown in FIG. 3 because its pins 61*c* are guided by the elongated holes 43. Therefore, also the idle roller 60 is able to move in the directions indicated by the arrows a1 and a2.

A spring retaining portion 64 is provided for the upper portion of one side surface of the idle roller holder 61. A roller spring (a compression spring) 65, which is a roller urging means, is disposed between the spring retaining portion 64 and the cover 70. Therefore, the idle roller holder 61 is always urged into a direction indicated by the arrow a1 by the roller spring 65. Since the idle roller 60 is brought into contact with the separation pad 50, its movement is restrained. The urging force of the roller spring 65 is made to be smaller than the urging force of the pad spring 56. Therefore, the idle roller 60 does not downwardly push the separation pad 50.

On the other hand, a cam follower 66 is provided for the lower surface of the spring retaining portion 64. The cam follower 66 is brought into contact with a cam 23 provided for the foregoing bushing 21 or separated from the cam 23 so that the idle roller holder 61 is moved in a direction indicated by the arrow a1 or a2. Therefore, the idle roller 60 is also moved in the direction indicated by the arrow a1 or a2 (see FIG. 3). That is, the idle roller holder 61 and the cam 23 form an idle roller retracting mechanism. The shape of the cam 23 is structured in such a manner that the operation of the cam 23 separates the idle roller 60 from the separation pad 50 when the leading end of the paper sheet to be fed is allowed to pass through a space between the separation pad 50 and the idle roller 60 and brings the idle roller 60 into contact with the separation pad 50 after the leading end of the paper sheet has passed through the space between the separation pad 50 and the idle roller 60 as well as before the contact between the circular-arc portion 20*a* of the paper feeding roller 20 and the separation pad 50 through the paper sheet is suspended.

Referring to FIG. 4, symbol A indicates a range (a range of the widthwise direction of the paper sheet) through which the paper sheet passes.

The operation of the above-mentioned paper feeding apparatus and the printer will now be described in each case of a standby mode, a paper feeding operation, an operation for preventing the diagonal conveyance of the paper sheet and a printing operation.

Standby Mode

In the standby mode, the cam follower 34 of the hopper 30 is in contact with the hopper cam 35 of the paper feeding apparatus SF as indicated by a continuous line shown in FIG. 6 so that the hopper 30 is in a state where it has been pushed downwards. As shown in FIG. 3, the paper feeding roller 20 is in a state where its straight portion 20*b* faces the paper sheet P. The paper feeding roller 20 is not in contact with the paper sheet P.

Therefore, the paper sheet P can easily be set on the hopper 30 and the paper feeding tray 31 in the above-mentioned state.

Although the separation pad holder 51 (that is, the separation pad 50) is urged clockwise when viewed in FIG. 3 by the pad spring 56, its rotation is restrained because the projection 57 is brought into contact with the pin 41 as shown in FIG. 4. Thus, the separation pad holder 51 is stopped at a position shown in FIG. 3. Therefore, the urging force of the pad spring 56 does not act on the idle roller 60. At this time, the separation pad 50 is located in a rotation locus for the circular-arc portion 20*a* of the paper feeding roller.

The cam 23 and the cam follower 66 of the idle roller holder 61 are not in contact with each other. Therefore, the idle roller 60 is in contact with the separation pad 50 by the urging force of the roller spring 65.

Paper Feeding Operation (i) Referring to FIG. 3, the paper-feeding roller shaft 22 starts rotating clockwise. Therefore, the paper feeding roller 20 and the cam 23 also start rotating.

Figure 7:
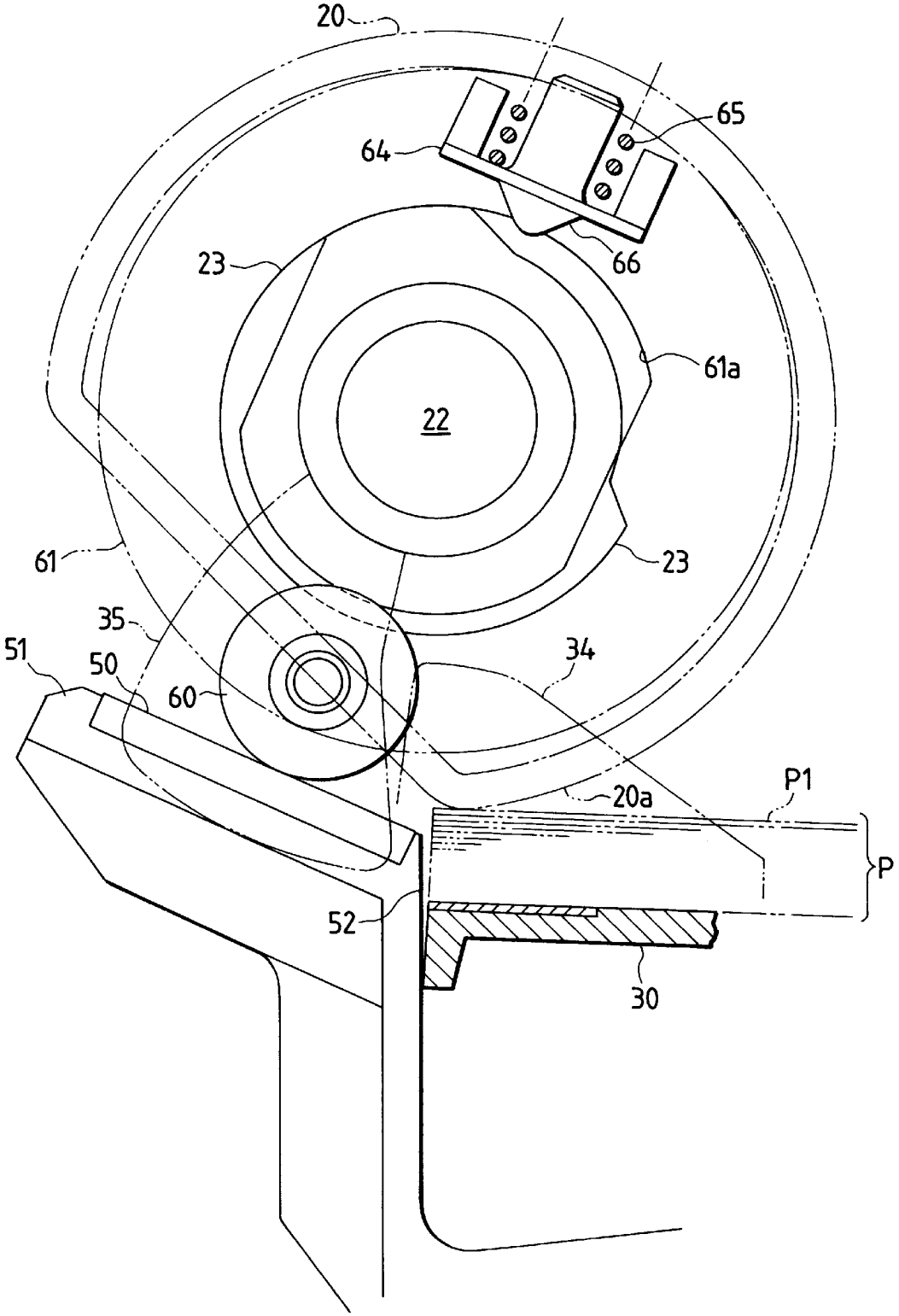
FIG. 7 is an explanatory view of the operation.

(ii) As shown in FIG. 7, the paper feeding roller 20 and the hopper cam 35 are, together with the paper-feeding roller shaft 22, rotated for a predetermined angle so that the contact between the hopper cam 35 and the cam follower 34 of the hopper 30 is suspended. Thus, the hopper 30 is pushed upwards by the hopper spring 33, and also the paper sheet P is pushed upwards so that the uppermost paper sheet P1 is pressed against the circular-arc portion 20*a* of the paper feeding roller 20.

Figure 8:
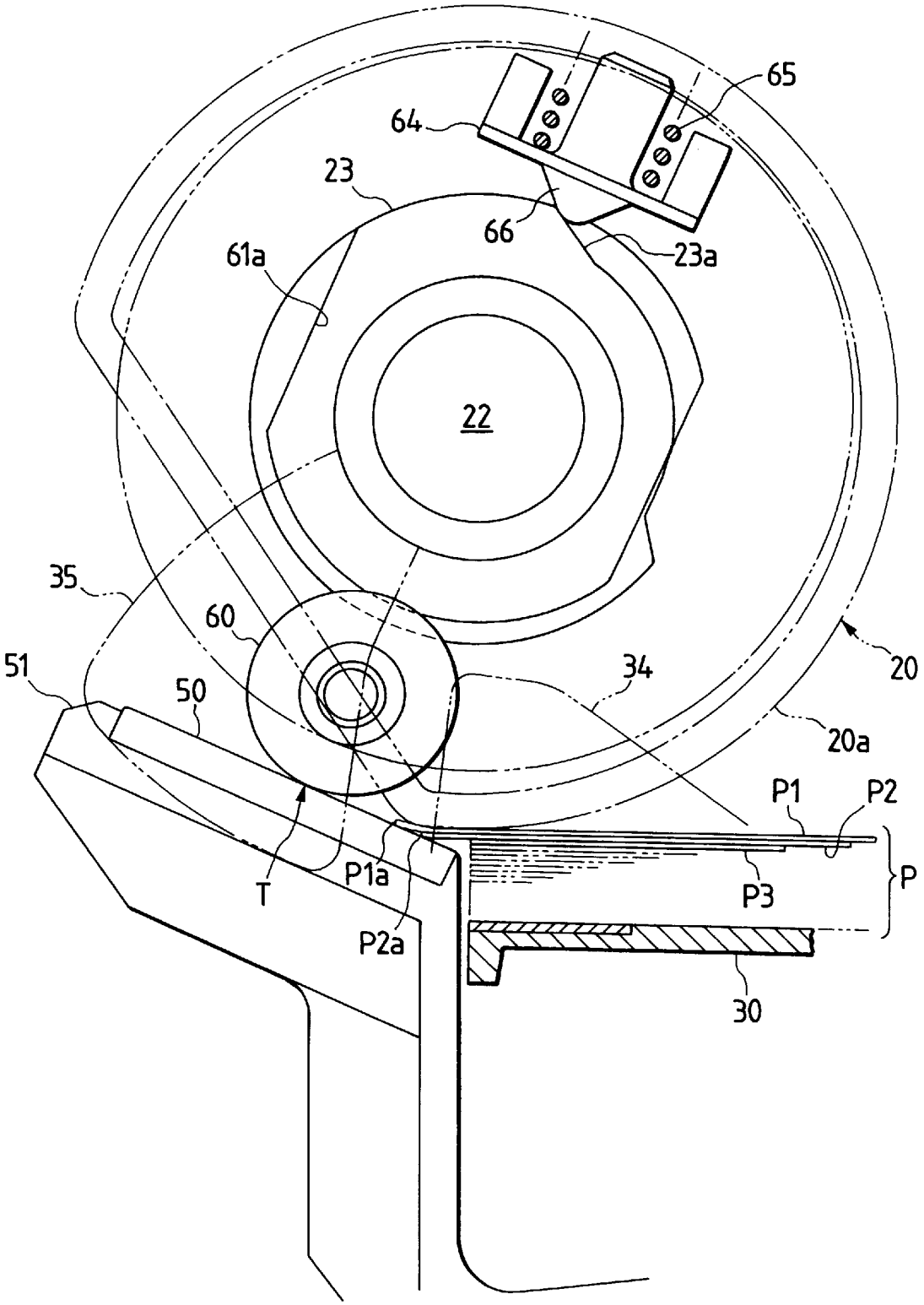
FIG. 8 is an explanatory view of the operation.

(iii) Since the rotation of the paper-feeding roller shaft 22 is further continued, the paper sheet P1 is fed toward the separation pad 50 because the circular-arc portion 20*a* of the paper feeding roller 20 and the uppermost paper sheet P1 are in contact with each other as shown in FIG. 8. Since a paper sheet P2 next to the paper sheet P1 sometimes becomes attached to the paper sheet P1 due to the static electricity or frictional force acting between the paper sheet P1 and the paper sheet P2, the paper sheet P2 is sometimes fed together with the paper sheet P1. However, since the leading end P2*a* (see FIG. 8) of the paper sheet P2 is brought into contact with the separation pad 50, the movement of the paper sheet P2 is prevented, and thus the paper sheet P2 is primarily separated from the paper sheet P1. Even if the following paper sheet P3 or additional sheets are fed, they can be separated similarly.

Although an inclined surface 23*a* of each of the cam 23 is, at this time (the moment shown in FIG. 8), brought into contact with the cam follower 66 of the idle roller holder 61, the leading end P1*a* of the uppermost paper sheet P1 has not reached the contact portion T between the idle roller 60 and the separation pad 50.

Figure 9:
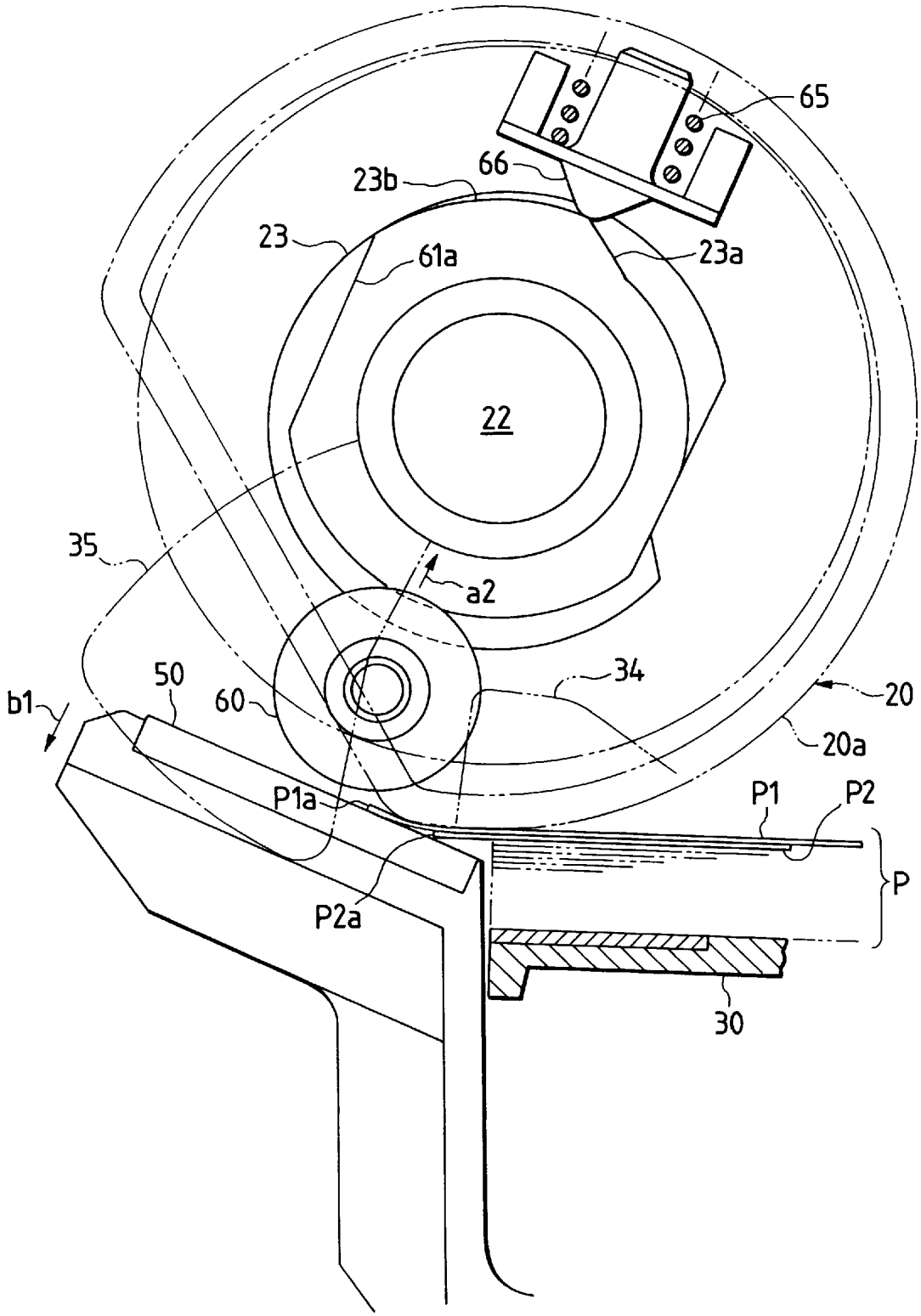
FIG. 9 is an explanatory view of the operation.

(iv) Since the paper-feeding roller shaft 22 is further continuously rotated, the circular-arc portion 20*a* of the paper feeding roller 20 presses the separation pad 50 through the uppermost paper sheet P1, as shown in FIG. 9. As a result, the separation pad 50 is pushed downwards in the direction indicated by an arrow b1 against the urging force of the pad spring 56. Simultaneously, it holds the uppermost paper sheet P1 between the circular-arc portion 20*a* of the paper feeding roller 20 and the separation pad 50 attributable to the urging force of the pad spring 56. That is, the paper sheet P1 is fed in a state where it is held by the paper feeding roller 20 and the separation pad 50. In this state, the paper sheet P2 is attempted to be fed together with the paper sheet P1 as described above. The structure is arranged such that the relationship $\mu 1>\mu 2>\mu 3$ is satisfied as described above assuming that the coefficient of friction between the paper feeding roller 20 and the paper sheet is $\mu 1$, the coefficient of friction between the separation pad 50 and the paper sheet is $\mu 2$ and the coefficient of friction between the paper sheets is $\mu 3$. Therefore, when both of the paper sheets P1 and P2 are brought to a state where they are held between the circular-arc portion 20*a* of the paper feeding roller and the separation pad 50 after the paper feeding roller 20 has been rotated, the movement of the paper sheet P2 is prevented by the frictional force between the paper sheet P2 and the separation pad 50 so that the paper sheet P2 is secondarily separated from the paper sheet P1. Thus, only the paper sheet P1 can be fed.

At this time (the moment shown in FIG. 9), the cam follower 66 of the idle roller holder 61 is pushed upwards by the inclined surface 23*a* of the cam 23 so as to be moved to a position onto the circular-arc surface 23*b* of the pair of the cam 23. As a result, the idle roller 60 is moved in the direction indicated by the arrow a2 so that it is separated from the separation pad 50. However, the leading end P1*a* of the uppermost paper sheet P1 has not reached the contact portion T (see FIG. 8) between the idle roller 60 and the separation pad 50.

That is, when the leading end P1*a* of the paper sheet P1 is allowed to pass through the space between the separation pad 50 and the idle roller 60, the idle roller 60 has been separated from the separation pad 50.

Figure 10:
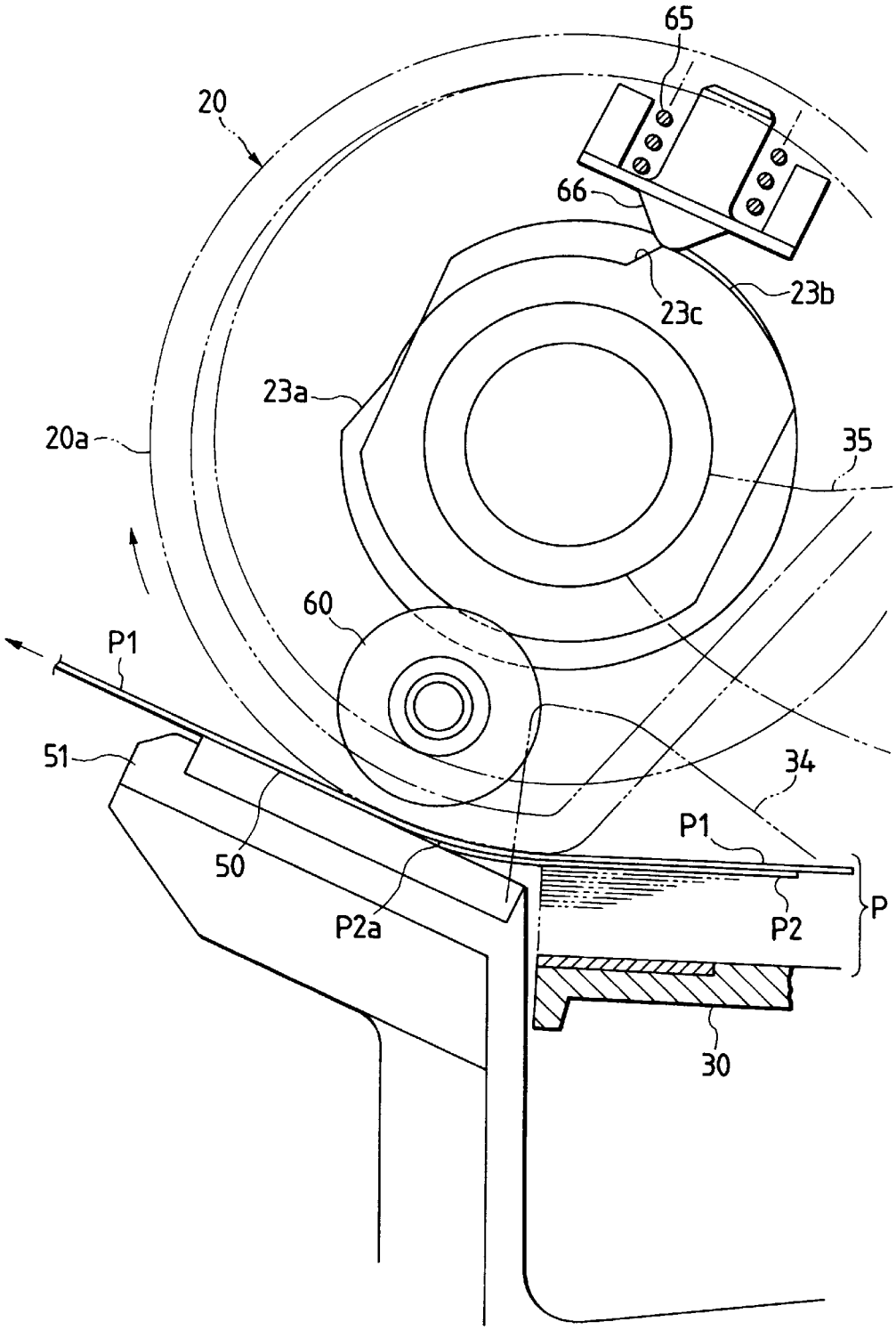
FIG. 10 is an explanatory view of the operation.

(v) Since the paper-feeding roller shaft 22 is further continuously rotated, the paper sheet P1 is fed while being held between the paper feeding roller 20 and the separation pad 50, as shown in FIG. 10.

At this time (the moment shown in FIG. 10), the cam follower 66 of the idle roller holder 61 is located at the end of the circular-arc surface 23*b* of the cam 23.

Figure 11:
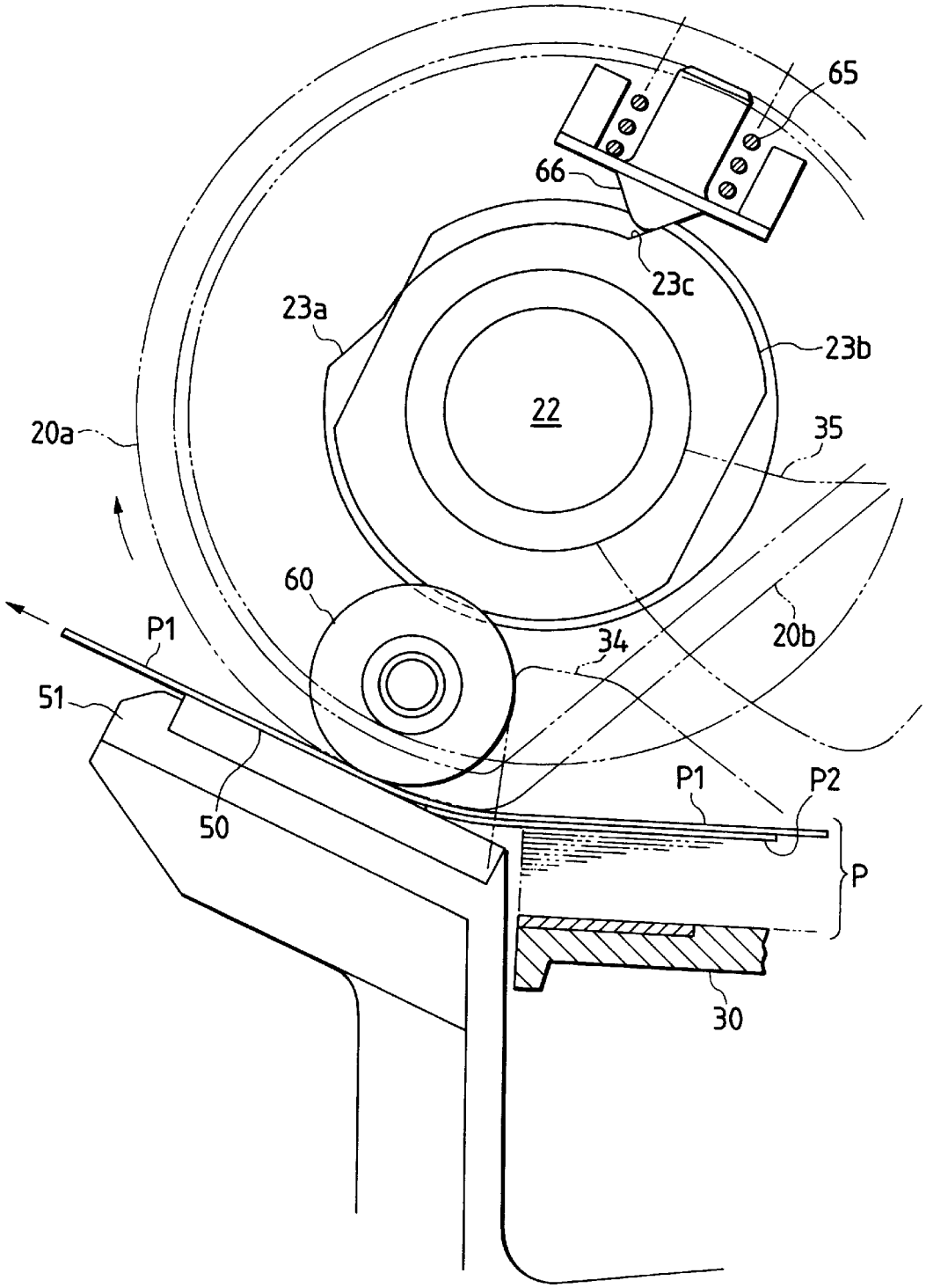
FIG. 11 is an explanatory view of the operation.

(vi) Since the paper-feeding roller shaft 22 is further continuously rotated, the paper sheet P1 is further fed in a state where it is held between the paper feeding roller 20 and the separation pad 50, as shown in FIG. 11.

At this time (the moment shown in FIG. 11), the cam follower 66 of the idle roller holder 61 slips down along another inclined surface 23*c* of the cam 23. Therefore, the urging force of the roller spring 65 causes the idle roller 60 to be brought into contact with the separation pad 50. However, the circular-arc portion 20*a* of the paper feeding roller 20 is, at this time, pressing the separation pad 50 through the paper sheet P1.

That is, the idle roller 60 is brought into contact with the separation pad 50 before the contact between the circular-arc portion 20*a* of the paper feeding roller and the separation pad 50 through the paper sheet P1 is suspended.

Figure 12:
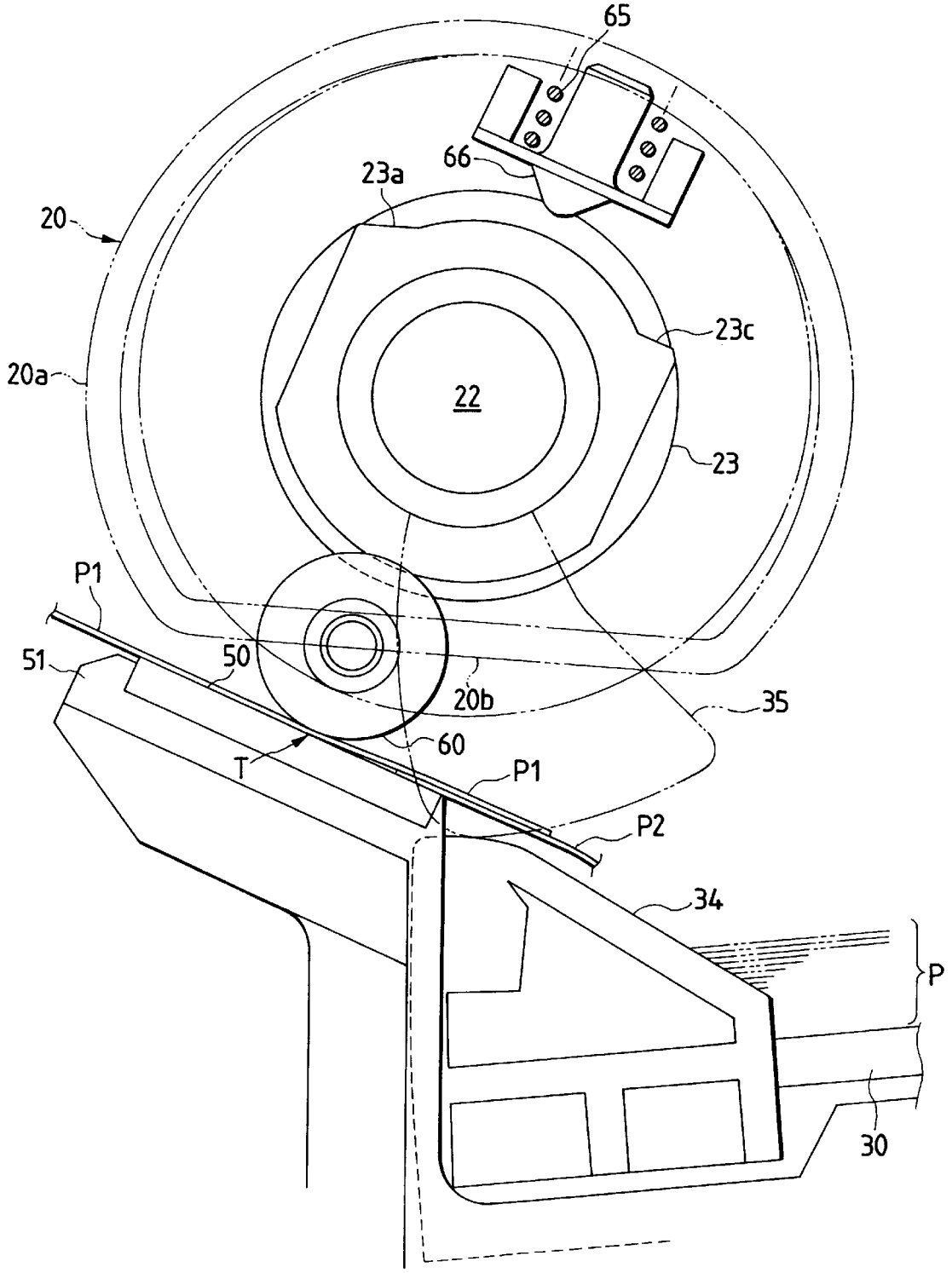
FIG. 12 is an explanatory view of the operation.
Figure 13:
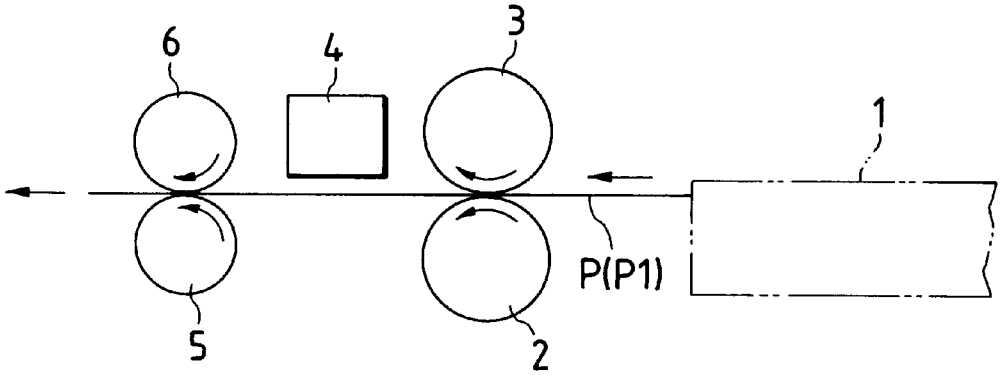
FIG. 13 RELATED ART
FIG. 13 is an explanatory view of a conventional technique.
Figure 14:
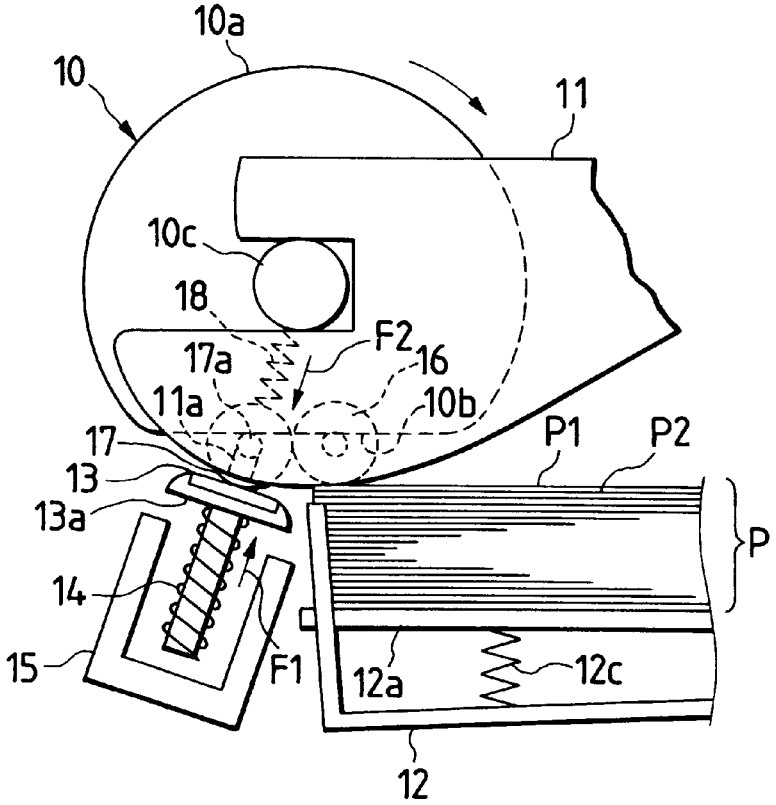
FIG. 14 RELATED ART
FIG. 14 is an explanatory view of a conventional technique.
Figure 15A:
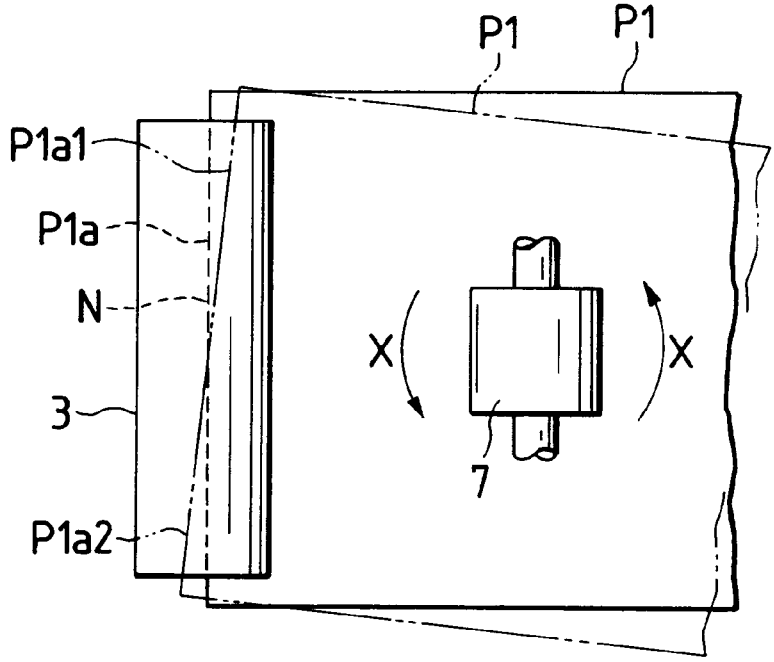
FIG. 15(a) RELATED ART
FIGS. 15 (*a*) and 15 (*b*) are explanatory views of a conventional technique.
Figure 15B:
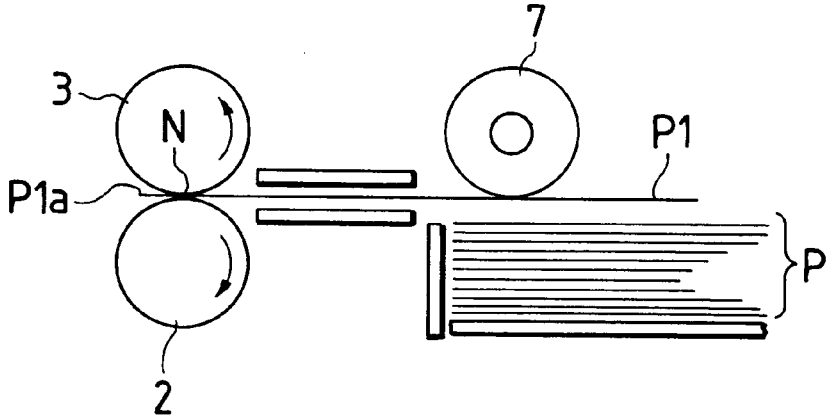
FIG. 15(b) RELATED ART
Figure 16A:
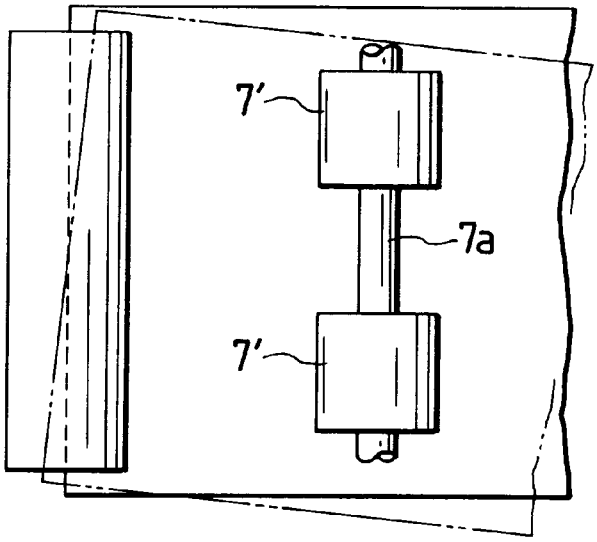
FIG. 16(a) RELATED ART
FIGS. 16 (*a*) and 16 (*b*) are explanatory views of a conventional technique.
Figure 16B:
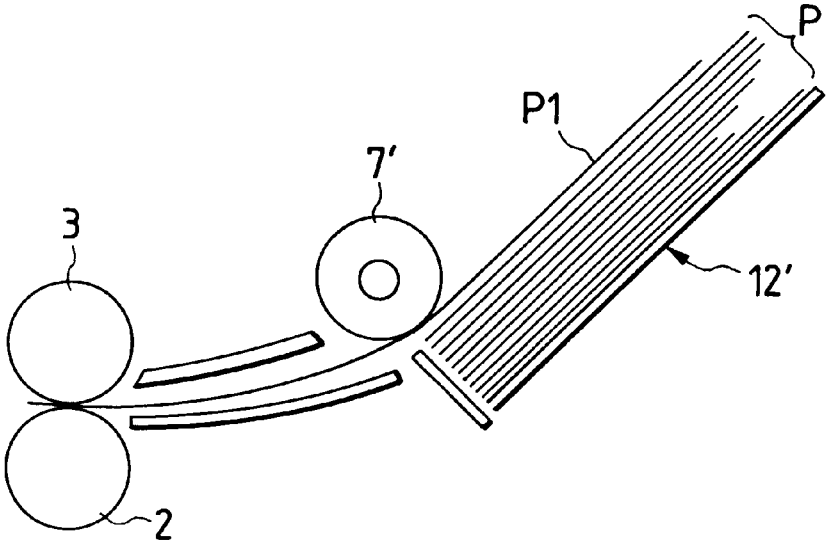
FIG. 16(b) RELATED ART

(vii) The paper-feeding roller shaft 22 is further rotated (rotated one time) so that the hopper 30 is, as shown in FIG. 12, pushed downwards by the hopper cam 35 and a standby state is restored (the state shown in FIG. 3).

Note that the paper sheet P1 has not completely been discharged from the paper feeding apparatus at this time. That is, the rear portion of the paper sheet is held by the contact portions T and T' (see FIG. 2) between the separation pad 50 and the idle roller 60.

Operation for Preventing Diagonal Conveyance of Paper Sheet

When the paper-feeding roller shaft 22 is rotated during the paper feeding operation, also the pair of the conveying rollers 2 and 3 shown in FIG. 1 are rotated forwards (rotated in the paper feeding direction).

The paper sheet P1 fed by the rotation of the paper feeding roller 20 is guided by a paper-sheet guide 80 toward the pair of the conveying rollers 2 and 3.

When the paper feeding roller 20 has been rotated one time, the leading end P1*a* of the paper sheet P1 slightly passes through the nipping portion N between the pair of the conveying rollers 2 and 3, as indicated by the imaginary line shown in FIG. 2.

Then, the pair of the conveying rollers 2 and 3 are temporarily rotated into the inverted direction (the direction indicated by an arrow shown in FIG. 1).

When the pair of the conveying rollers 2 and 3 are rotated inversely in a case where the paper sheet P1 is conveyed diagonally as indicated by the imaginary line shown in FIG. 2, the timing, at which the leading end P1*a* of the paper sheet passes through, in the opposite direction, the nipping portion N between the pair of the conveying rollers 2 and 3, varies according to the widthwise direction of the paper sheet. If the paper sheet P1 is diagonally conveyed as indicated by the imaginary line shown in FIG. 2, the leading end P1*a*2 in the lower portion (the right-hand portion in the widthwise direction of the sheet) when viewed in FIG. 2 is allowed to pass through the nipping portion N after the leading end P1*a*1 in the upper portion (in the left-hand portion in the widthwise direction of the sheet) has passed through the same. That is, a state is realized in which the conveying force generated by the pair of the conveying rollers 2 and 3 does not act on the leading end P1*a*1 in the upper portion, and the conveying force acts on the leading end P1*a*2 in the lower portion.

In the above-mentioned state, the rear portion of the paper sheet is held by the contact portions T and T' between the separation pad 50 and the idle roller 60. Therefore, if the conveying force acts on only the leading end P1*a*2 in the lower portion of the paper sheet, one contact portion T (which is the upper contact portion in the case shown in FIG. 2) acts as a load for the paper sheet which is fed inversely. Therefore, the paper sheet P1 is rotated in a direction indicated by an arrow X1 shown in FIG. 2. As a result, the leading end P1*a* of the paper sheet is arranged along the nipping portion N between the pair of the conveying rollers 2 and 3, as indicated by a dashed line shown in FIG. 2. Note that the idle roller 60 in the other contact portion T' is rotated to follow the paper sheet which is rotated in the direction indicated by the arrow X1.

Printing Operation

Then, the pair of the conveying rollers 2 and 3 are rotated forwards so that the paper sheet P1 is conveyed straight, and then printed by the printing means 4, followed by being discharged to the outside of the apparatus by a pair of paper discharge rollers 5 and 6.

Note that the paper sheet P1 is conveyed by the pair of the conveying rollers 2 and 3 in a state where it is applied with the loads from the contact portions T and T' until the rear end of the paper sheet P1 passes through the contact portions T and T' between the separation pad 50 and the idle roller 60.

In this state, the idle roller 60 has been urged by the roller spring 65 toward the separation pad 50 and thus the paper sheet P1 has been held between the idle roller 60 and the separation pad 50. Therefore, if the next paper sheet P2 becomes attached to the paper sheet P1 due to the static electricity or the frictional force generated between the paper sheet P1 and the paper sheet P2, and is attempted to be fed together with the paper sheet P1, the conveyance of the paper sheet P2 can be prevented.

The paper feeding apparatus structured as described above attains the following effects. ( a) Since the paper feeding roller 20 having a D-shape side cross sectional shape, provided with the circular-arc portion 20*a* and the straight portion 20*b* and arranged to be rotated one time when a paper sheet is fed so that the circular-arc portion 20*a* is brought into contact with the uppermost paper sheet P1 among the plurality of the stacked paper sheets P so as to feed the paper sheet P1; and the separation pad 50 located in the rotation locus of the circular-arc portion 20*a* of the paper feeding roller 20, urged by the pad spring 56 toward the paper feeding roller 20 to hold the paper sheet between the circular-arc portion 20*a* and the separation pad 50 so as to separate the paper sheet P1 which must be fed by the paper feeding roller 20 from the next paper sheet P2 are provided, only the uppermost paper sheet P1 is fed when the paper feeding operation is performed.

After the uppermost paper sheet P1 has been fed, the circular-arc portion 20*a* of the paper feeding roller is, as shown in FIG. 12, brought to a state where it is not in contact with the paper sheet, that is, a state where the separation pad 50 does not hold the paper sheet P1 between the separation pad 50 and the circular-arc portion 20*a* of the paper feeding roller 20. The idle roller 60 is urged by the roller spring 65 for generating the urging force smaller than the urging force of the pad spring 56 toward the separation pad 50 and thus the idle roller 60 is in contact with the separation pad 50. Therefore, the paper sheet P1 is brought to a state where it is held between the idle roller 60 and the separation pad 50.

Since the above-mentioned paper feeding apparatus is provided with the pin 41 serving as a pad restraining means provided individually from the idle roller 60 and arranged to restrain the movement of the separation pad 50 toward the paper feeding roller 20 when the separation pad 50 does not hold the paper sheet P1 between the separation pad 50 and the circular-arc portion 20*a* of the paper feeding roller, the urging force of the pad spring 56 is received by the above-mentioned pin 41.

Therefore, the force for holding the paper sheet P1 can be obtained from the roller spring 65. Since the urging force of the roller spring 65 is smaller than the urging force of the pad spring 56, the force for holding the paper sheet P1 can be reduced as compared with that required for the conventional apparatus.

The reason why the structure of the above-mentioned paper feeding apparatus is formed such that the idle roller 60 is urged toward the separation pad 50 so as to hold the paper sheet P1 between the idle roller 60 and the separation pad 50 lies in that conveyance of the paper sheet P2 together with the paper sheet P1 which may become attached due to static electricity or friction force acting between the paper sheet P1 and the paper sheet P2 must be prevented during the conveyance of the paper sheet P1 by the pair of the conveying rollers 2 and 3. The urging force of the roller urging means (which is roller spring 65 in this case) can be reduced within the range capable of achieving the above-mentioned object.

Therefore, the foregoing paper feeding apparatus is able to reduce the load which acts on the paper sheet P1 after the uppermost paper sheet P1 has been fed as compared with the conventional apparatus. As a result, the printer comprising the above-mentioned paper feeding apparatus is able to operate the pair of the conveying rollers 2 and 3 with a relatively small operating force. Moreover, the printing accuracy can be improved.

(b) When the paper feeding operation is performed such that the uppermost paper sheet P1 is fed because of the rotation of the paper feeding roller 20 and the leading end Pla of the paper sheet P1 is allowed to pass through the contact portion T between the circular-arc portion 20*a* of the paper feeding roller 20 and the separation pad 50 (see FIG. 9), the idle roller 60 which is in contact with the separation pad 50 acts as a resistance for the paper sheet which is attempted to pass through if the contact takes place.

However, since the above-mentioned paper feeding apparatus is provided with the retracting mechanism for separating the idle roller 60 from the separation pad 50 when the leading end P1*a* of the paper sheet P1 required to be fed is allowed to pass through the separation pad 50 and the idle roller 60, the idle roller 60 does not act as the resistance for preventing the paper sheet P1 from passing through the contact portion.

Since the retracting mechanism brings the idle roller 60 into contact with the separation pad 50 (see FIG. 11) after the leading end P1*a* of the paper sheet P1 has been allowed to pass through the space between the separation pad 50 and the idle roller 60 and before the contact between the circular-arc portion 20*a* of the paper feeding roller and the separation pad 50 through the paper sheet P1 is suspended, feeding of the next paper sheet P2 together with the uppermost paper sheet P1 occurring after the contact between the circular-arc portion 20*a* of the paper feeding roller and the separation pad 50 through the paper sheet P1 has been suspended can be prevented (see FIG. 12).

(c) Since the structure is arranged such that the idle roller retracting mechanism is provided for the paper-feeding roller shaft 22 so as to be operated by the cam 23 which is rotated together with the paper-feeding roller shaft 22, the structure can be simplified. The structure can be simplified as compared with, for example, a structure which is operated by a solenoid.

The above-mentioned printer attains the following effects.

(d) The objects of the above described embodiment in which the idle roller 60 is urged toward the separation pad 50 so as to hold the paper sheet P1 between the idle roller 60 and the separation pad 50 is to prevent conveyance of the paper sheet P2 together with the paper sheet P1 during the conveyance of the paper sheet P1 by the pair of the conveying rollers 2 and 3 which can occur due to the static electricity or frictional force acting between the paper sheet P1 and the paper sheet P2.

Another object is to apply a load (resistance) to the paper sheet which is conveyed inversely when the operation for preventing the diagonal conveyance is performed so as to rotate the paper sheet.

Therefore, the foregoing printer is able to reduce the urging force of the roller urging means (which is the roller spring 65 in this case) in the range capable of simultaneously achieving the foregoing objects.

Specifically, holding force TF1 required to prevent conveyance of the next paper sheet P2 together with the paper sheet P1 during the process of conveying the paper sheet P1 by the pair of the conveying rollers 2 and 3, holding force TF2 required to apply a load (resistance) to the paper sheet, which is conveyed inversely, to rotate the paper sheet, and holding force TF3 required between the pad and the paper feeding roller to separate the pad when the paper sheet is fed have the following relationship $TF1 \leqq TF2 < TF3$. Therefore, the above-mentioned printer is able to reduce the urging force of the roller urging means (which is the roller spring 65 in this case) in a range in which the foregoing relationships can be satisfied.

In this embodiment, the relationship $TF1 = TF2 < TF3$ is satisfied.

In the above-mentioned state, when the pair of the conveying rollers 2 and 3 are temporarily and inversely rotated after the leading end of the paper sheet P1 has passed through the nipping portion N between the pair of the conveying rollers 2 and 3, the paper sheet P1 is smoothly rotated in the holding portion because the trailing end of the paper sheet P1 is held between the idle roller 60 and the separation pad 50 with the relatively weak holding force TF2. As a result, the leading end P1*a* of the paper sheet P1 diagonally conveyed is arranged along the nipping portion N between the pair of the conveying rollers 2 and 3.

That is, the above-mentioned printer is able to effectively prevent diagonal conveyance of the paper sheet.

(e) Since the paper feeding tray 31 is, as shown in FIG. 1, inclined to hold the paper sheets in a state where the paper sheets are inclined, the overall area required to dispose the printer can be reduced.

Since one pair of the paper feeding rollers 20 are provided, excessive diagonal conveyance of the paper sheet when the paper sheet is fed can be prevented in a similar manner achieved in the operation described in (d).

Although the invention has been described in its preferred form with a certain degree of particularity, it is understood that the present disclosure of the preferred form can be changed in the details of construction and in the combination and arrangement of parts without departing from the spirit and the scope of the invention.

What is claimed is:

1. A paper feeding apparatus comprising:

a paper feeding roller being D-shaped in a side cross sectional view, and including a circular-arc portion and a straight portion, said paper feeding apparatus being rotated one time, so that said circular-arc portion is brought into contact with an uppermost paper sheet of a plurality of stacked paper sheets so as to feed said uppermost paper sheet;

a separation pad located in a rotation locus of said circular-arc portion of said paper feeding roller and being urged by pad urging means toward said paper feeding roller, so that said paper sheets are held between said separation pad and said circular-arc portion so as to separate said uppermost paper sheet fed by said paper feeding roller from said plurality of stacked paper sheets;

an idle roller which is urged toward said separation pad by roller urging means for generating an urging force smaller than an urging force generated by said pad urging means so as to be brought into contact with said separation pad; and pad restraining means for restraining movement of said separation pad toward said paper feeding roller when said separation pad does not hold said uppermost paper sheet between said separation pad and said circular-arc portion of said paper feeding roller, said pad restraining means being provided individually from said idle roller.

2. The paper feeding apparatus according to claim 1, further comprising an idle-roller retracting mechanism for separating said idle roller from said separation pad when a leading end of said uppermost paper sheet to be fed passes between said separation pad and said idle roller and bringing said idle roller into contact with said separation pad after the leading end of said uppermost paper sheet has passed between said separation pad and said idle roller and before contact between said circular-arc portion of said paper feeding roller and said separation pad through said paper sheet is suspended.

3. The paper feeding apparatus according to claim 2, wherein said idle-roller retracting mechanism is attached to a shaft of said paper feeding roller and arranged to be operated by a cam which is rotated together with said shaft.

4. The paper feeding apparatus according to claim 2, wherein said idle-roller retracting mechanism comprises:

an idle roller holder having pins, said pins being disposed on a side surface of said idle roller holder and slidably received within elongated holes of a subframe so that said idle roller holder slides in a direction perpendicular to a longitudinal axis of a shaft which supports said paper feeding roller; and a cam fixed to said shaft for moving said idle roller holder in said direction.

5. The paper feeding apparatus according to claim 1, wherein said paper feeding roller is made of a material having a first coefficient of friction, said separation pad is made of a material having a second coefficient of friction, wherein said first coefficient of friction is greater than said second coefficient of friction, and wherein said second coefficient of friction is greater than a coefficient of friction of said paper sheets.

6. A printer comprising:

a feeding tray for holding a plurality of paper sheets in a state where said paper sheets are stacked;

a paper feeding roller being D-shaped in a side cross sectional view, and including a circular-arc portion and a straight portion, said paper feeding apparatus being rotated one time, so that said circular-arc portion is brought into contact with an uppermost paper sheet of the plurality of stacked paper sheets on said feeding tray so as to feed said uppermost paper sheet;

a separation pad located in a rotation locus of said circular-arc portion of said paper feeding roller and being urged by pad urging means toward said paper feeding roller, so that said paper sheets are held between said separation pad and said circular-arc portion so as to separate said uppermost paper sheet fed by said paper feeding roller from said plurality of stacked paper sheets;

an idle roller which is urged toward said separation pad by roller urging means for generating an urging force smaller than an urging force generated by said pad urging means so as to be brought into contact with said separation pad;

pad restraining means for restraining movement of said separation pad toward said paper feeding roller when said separation pad does not hold said uppermost paper sheet between said separation pad and said circular-arc portion of said paper feeding roller, said pad restraining means being provided individually from said idle roller; and a pair of conveying rollers for conveying said uppermost paper sheet fed by said paper feeding roller;

wherein said pair of conveying rollers are temporarily rotated in an inverse direction to arrange a leading end of said uppermost paper sheet along a nipping portion between said pair of conveying rollers after the leading end of said paper sheet has passed through said nipping portion between said pair of conveying rollers and in a state where said separation pad and said circular-arc portion of said paper feeding roller do not hold said uppermost paper sheet.

7. The printer according to claim 6, wherein said paper feeding tray is a paper feeding tray which is inclined to hold said paper sheets in an inclined state, and at least one pair of said paper feeding rollers is provided.

8. The printer according to claim 6 further comprising, an idle-roller retracting mechanism for separating said idle roller from said separation pad when the leading end of said uppermost paper sheet to be fed passes between said separation pad and said idle roller and bringing said idle roller into contact with said separation pad after the leading end of said uppermost paper sheet has passed between said separation pad and said idle roller and before contact between said circular-arc portion of said paper feeding roller and said separation pad through said paper sheet is suspended.

9. The printer according to claim 8, wherein said idle-roller retracting mechanism is attached to a shaft of said paper feeding roller and arranged to be operated by a cam which is rotated together with said shaft.

10. The printer according to claim 8, wherein said idle-roller retracting mechanism comprises:

an idle roller holder having pins, said pins being disposed on a side surface of said idle roller holder and slidably received within elongated holes of a subframe so that said idle roller holder slides in a direction perpendicular to a longitudinal axis of a shaft which supports said paper feeding roller; and a cam fixed to said shaft for moving said idle roller holder in said direction.

11. The printer according to claim 6, wherein said paper feeding roller is made of a material having a second coefficient of friction, wherein said first coefficient of friction is greater than said second coefficient of friction, and wherein said second coefficient of friction is greater than a coefficient of friction of said paper sheets.

* * * * *